US006542615B1

(12) United States Patent
Ito

(10) Patent No.: US 6,542,615 B1
(45) Date of Patent: Apr. 1, 2003

(54) HEADPHONE

(75) Inventor: Tomohiro Ito, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/615,204

(22) Filed: Jul. 13, 2000

(30) Foreign Application Priority Data

Jul. 13, 1999 (JP) ..... 11-199198

(51) Int. Cl.[7] ..... H04R 25/00
(52) U.S. Cl. ..... 381/374; 381/370
(58) Field of Search ..... 381/182, 370–371, 381/374, 378–379, 386, FOR 149; 379/430

(56) References Cited

U.S. PATENT DOCUMENTS 4,065,645 A * 12/1977 Warner et al. ..... 381/371
4,138,598 A * 2/1979 Cech ..... 379/430
4,542,803 A * 9/1985 Houng ..... 181/129
4,588,868 A * 5/1986 Bertagna et al. ..... 181/129
4,689,822 A * 8/1987 Houng ..... 381/371
4,949,806 A * 8/1990 Hofer ..... 181/129
4,965,836 A * 10/1990 Andre et al. ..... 181/129
5,035,005 A * 7/1991 Hung ..... 2/209
5,095,382 A * 3/1992 Abe ..... 320/107
5,109,424 A * 4/1992 Andre et al. ..... 381/371
5,117,464 A * 5/1992 Jones et al. ..... 181/129
5,793,878 A * 8/1998 Chang ..... 381/370
5,887,286 A * 3/1999 Waldron ..... 181/129
5,970,105 A * 10/1999 Leppalahti ..... 379/430

* cited by examiner

*Primary Examiner*—Rexford N. Barnie
*Assistant Examiner*—P. Dabney
(74) *Attorney, Agent, or Firm*—Jay H. Maioli

(57) ABSTRACT

A headphone capable of preventing foreign substances, dust and the like from entering a housing and of enhancing acoustic characteristics in which a hanger of a headband in a housing having a speaker unit is of a storage type and the housing can be swung in a driving direction or a twist direction with respect to the headband, includes an opening provided between the housing and the headband that is blocked by a shielding plate formed on one side of the hanger and a protruded portion formed on the side opposite to the shielding plate.

3 Claims, 9 Drawing Sheets

HEADPHONE

BACKGROUND OF THE INVENTION

1. Field of the Invention

The present invention relates to a headphone, and more particularly to a headphone in which a hanger of a headband is stored in a headphone housing (which will be hereinafter referred to as a housing) and an opening between the headphone housing and the swinging headband is concealed by shielding means, thereby preventing foreign substances, dust and the like from entering the housing. Moreover, the acoustic characteristics of the headphone can be enhanced.

2. Description of the Related Art

FIG. 8 shows an example of a conventional headphone. In the headphone, a housing 21 having a built-in speaker unit is pivotally supported on an exterior type hanger 23 provided in a headband 22. In this case, the headband 22 is attached to the top of a head portion and the housing 21 can be swung and adjusted in a driving direction by setting a pivot O in the longitudinal direction as the center of swinging. An operation for attaching the headphone has a problem in that attachment is hard to perform because fingers touch part of the hanger 23 when the housing 21 is held. Moreover, there is a problem in that the housing 21 supported swingably is unsteady and is attached with difficulty without pressing down the housing 21 while holding the hanger 23.

FIG. 9 shows an example of another headphone of a conventional type. The headphone also has such a structure that a housing 24 including a speaker unit is supported pivotally by an exterior type hanger 26 provided in a headband 25. In this case, the headband 22 is attached to a rear head portion and the housing 24 can be swung and adjusted in a twist direction by setting a pivot O in the vertical direction as the center of swinging. In this case, the headphone has a problem that if the headband 25 is to be spread in order to attach the headphone to the head portion by holding the housing 24 and the hanger 26, the housing 24 is turned from a pivot portion so that attachment property is very deteriorated.

FIG. 10 shows a headphone of a conventional type in which a hanger 27 is stored in a housing 28 in place of the above-mentioned exterior type hanger. By the hanger of a storage type, it is possible to eliminate the problem that the housing is unsteady or turned when the headphone is to be attached.

A headphone having a hanger of a storage type has such a structure that an arm 30 of a headband 29 coupled to the hanger 27 is drawn from the housing 28. In this case, the headband 29 is attached to the top of the head portion, and the housing 28 is provided with an opening 31 such that the housing 28 can be swung in the driving direction by setting the pivot O in the longitudinal direction as the center of swinging. However, since the opening 31 is formed on the housing 28, there is a problem that foreign substances, dust and the like enter the housing 28 or fingers are caught between the opening 31 and the arm 30 during the driving adjustment of the housing 28.

SUMMARY OF THE INVENTION

The present invention has been made to eliminate the above-mentioned problems and has an object to obtain a headphone capable of preventing foreign substances, dust and the like from entering a housing and of enhancing acoustic characteristics.

In order to attain the above-mentioned object, the present invention provides a headphone in which an opening formed in a coupling portion between a housing and a headband is concealed by shielding means.

According to the headphone having such a structure, the opening of the housing is always concealed by the shielding means. Therefore, foreign substances, dust and the like do not enter the housing. For example, if the shielding means shields the opening by means of a shielding plate extended from the hanger of the headband, the opening is always blocked by the shielding plate even in case the housing is swung in the driving direction or the twist direction. Consequently, it is possible to prevent the foreign substances, the dust and the like from entering the housing.

Moreover, the inside of the housing is divided by a partition wall and a speaker unit has a sealing structure. Consequently, the acoustic characteristics of a speaker can be enhanced.

DESCRIPTION OF THE PREFERRED EMBODIMENTS

An embodiment of a headphone according to the present invention will be described below with reference to the drawings.

Figure 1:
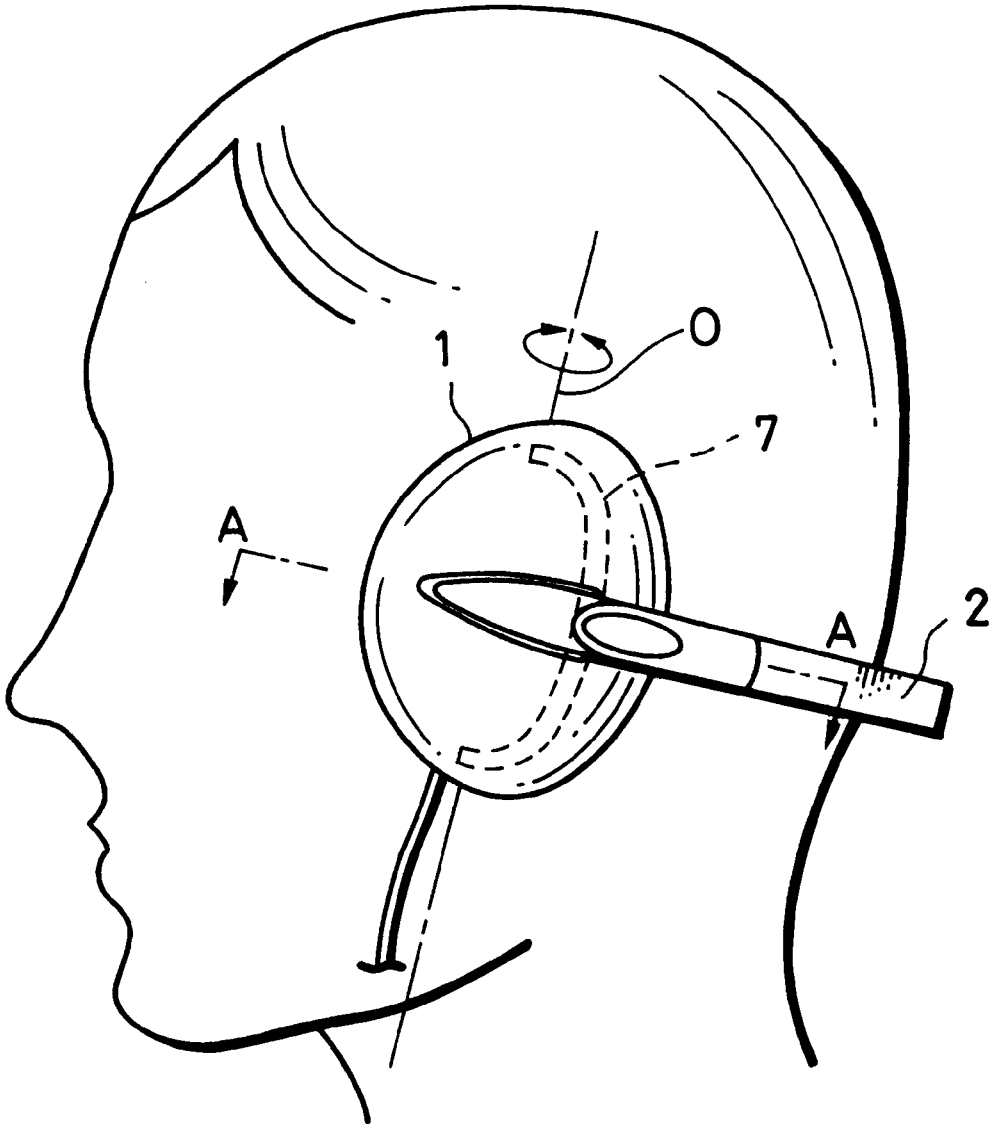
FIG. 1 is a view showing the appearance of a state in which a headphone according to the present invention is attached.
Figure 2:
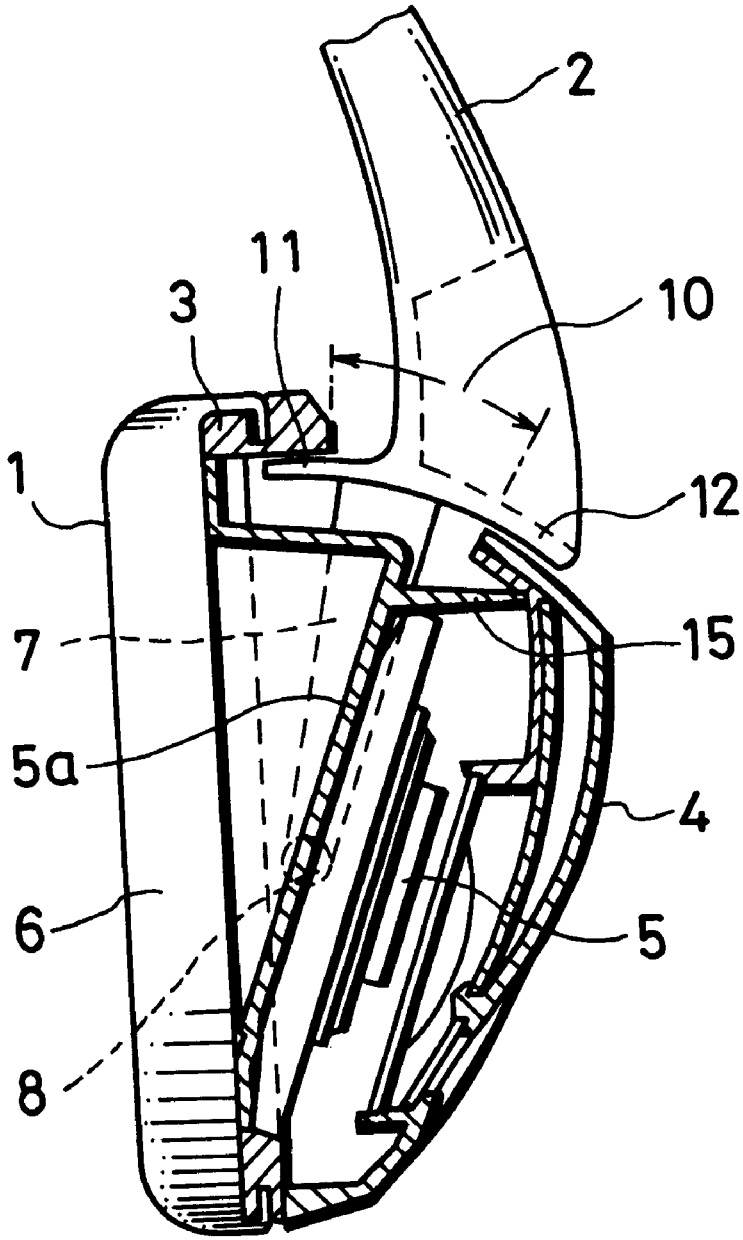
FIG. 2 is a sectional view taken along the line A—A of FIG. 1.
Figure 3:
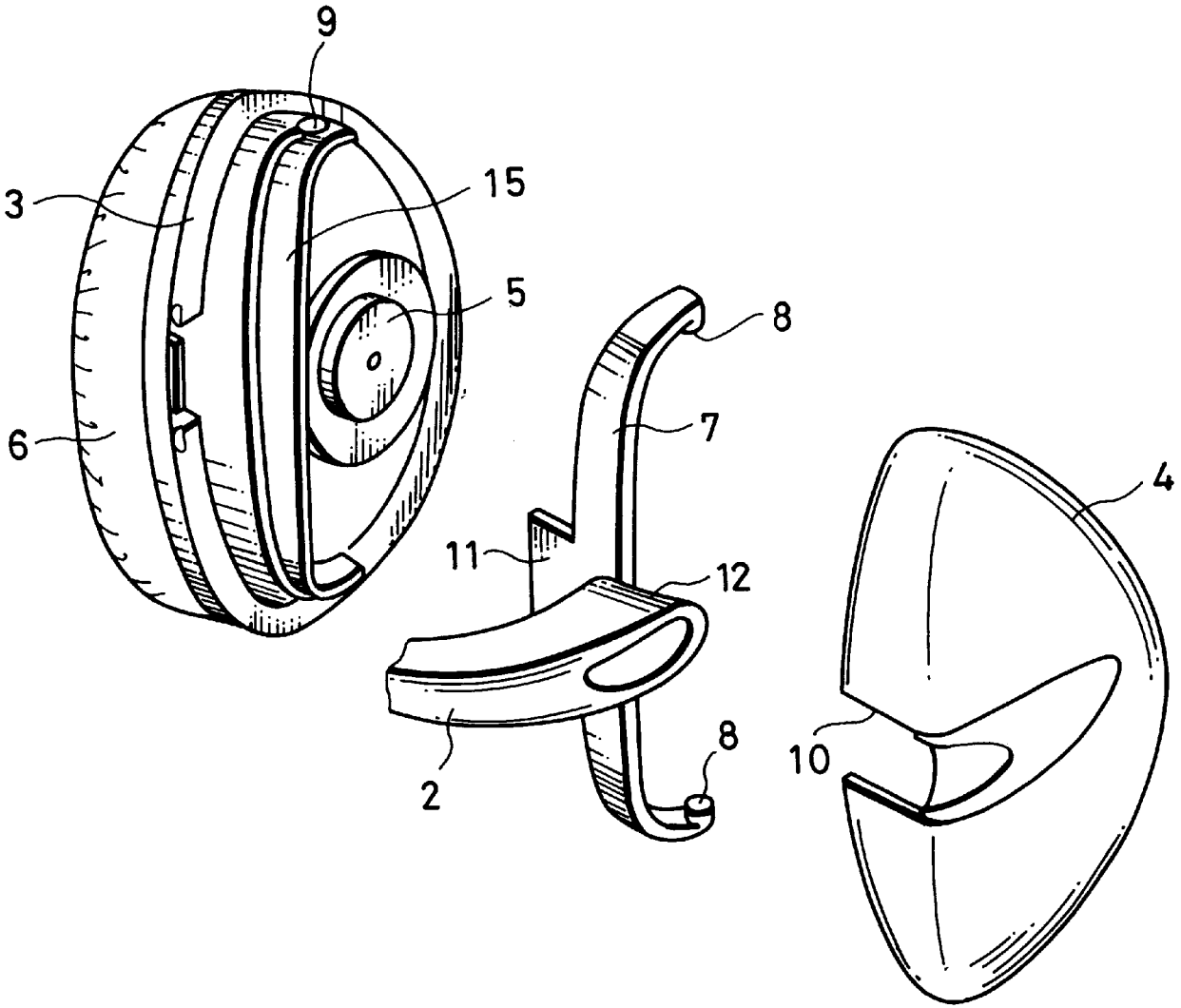
FIG. 3 is a perspective view showing the main part of a housing which is divided.

FIG. 1 is a view showing the appearance of a state in which the headphone is attached, FIG. 2 is a sectional view taken along the line A—A of FIG. 1, and FIG. 3 is a perspective view showing the main part of the headphone which is divided.

The headphone comprises a housing 1 and a headband 2 for swingably holding the housing 1. The housing 1 is constituted by a housing body 3 molded from a plastic material, a corrosion-resistive metal material or the like and a cover 4, and a speaker unit 5 is attached to the housing body 3. Moreover, an ear pad 6 is provided on the front face side of the housing body 3, that is, the sounding portion 5A side of the speaker unit 5.

The headband 2 has an arch-shaped hanger 7 provided integrally with an end, and convex shafts 8 and 8 provided in both tip portions of the hanger 7 are pivotally supported on shaft holes 9 and 9 (only one of the shaft holes 9 is shown in FIG. 3) of the housing body 3 so that the housing body 3 is held. The cover 4 is assembled into the housing body 3 having the headband 2 fixed thereto in order to cover the speaker unit 5 on the rear face side of the speaker unit 5 and is coupled with a screw which is not shown. Moreover, the hanger 7 of the headband 2 is also stored in the cover 4.

In the headphone having the above-mentioned structure, the headband 2 is attached to the rear head portion and the housing 2 can be adjusted in the twist direction by using a pivot O as the fulcrum of swinging with respect to the headband 2 as shown in FIG. 1. For this reason, the cover 4 should be provided with an opening 10 for guiding the headband 2. The opening 10 is blocked by a shielding member formed on the headband 2.

More specifically, as shown in FIG. 3 as an example of the shielding member, the shielding plate 11 is integrally extended from the hanger 7 and a portion 12 integrally protruded from the headband 2 is formed on the side opposite to the shielding plate 11.

Figure 4A:
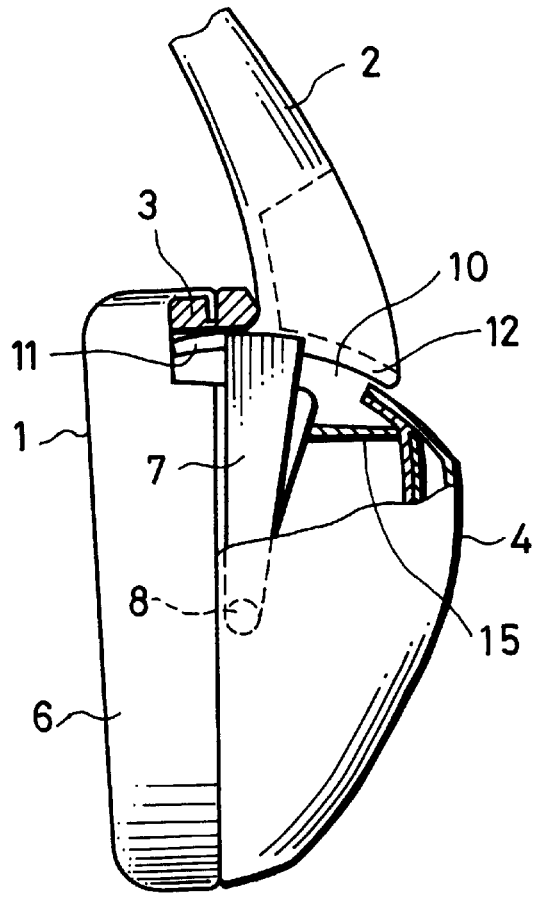
FIG. 4A is a partial sectional view showing a state in which an opening is blocked when the headphone is opened laterally.
Figure 4B:
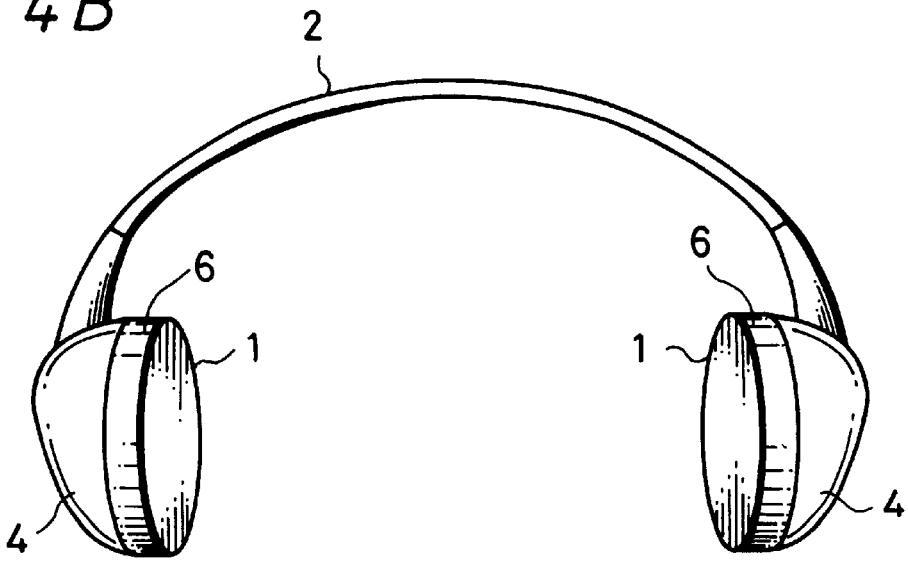
FIG. 4B is a view showing the appearance of a state in which the headphone is opened laterally.
Figure 5A:
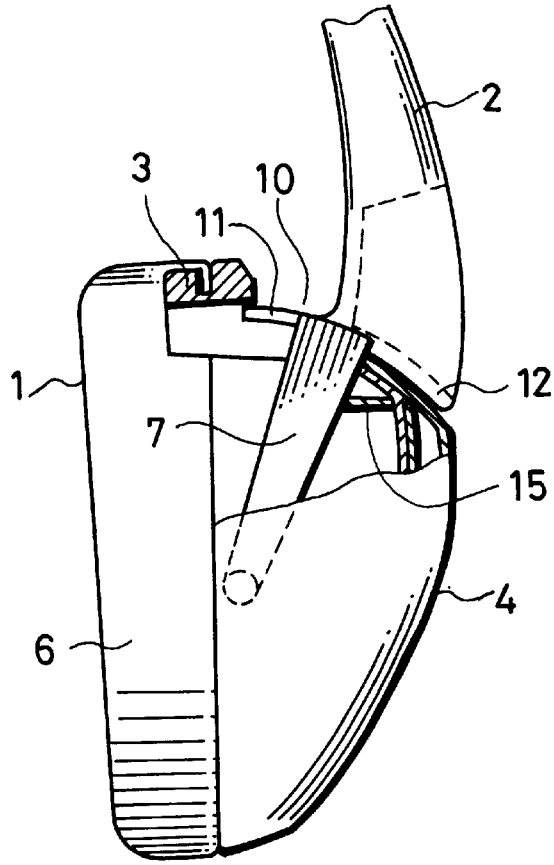
FIG. 5A is a partial sectional view showing a state in which the opening is blocked when the headphone is attached.
Figure 5B:
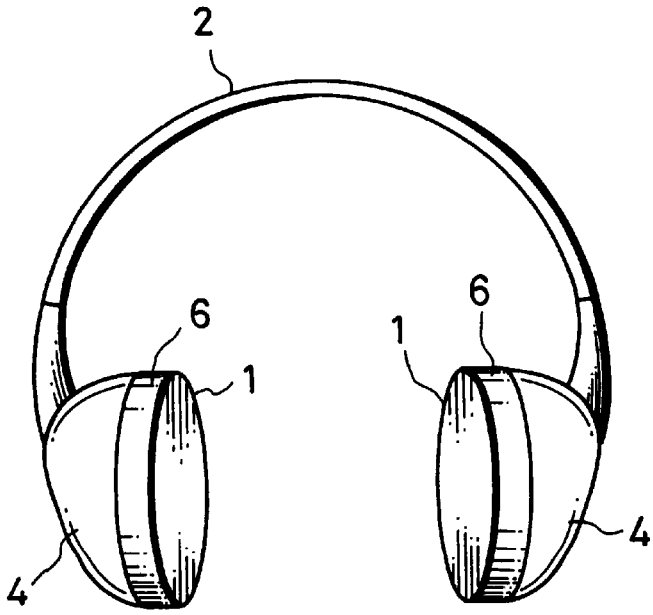
FIG. 5B is a view showing the appearance of a state in which the headphone is attached.

In the headphone according to the present invention, when a pair of housings 1 and 1 are laterally separated from each other during the attachment of the headphone as shown in FIG. 4B, the opening 10 of the housing 1 is blocked by the shielding plate 11 as shown in FIG. 4A. Moreover, in a state in which a pair of housings 1 and 1 are attached as shown in FIG. 5B, the opening 10 of the housing 1 is blocked by the protruded portion 12 of the headband 2 as shown in FIG. 5A. In some cases, the headphone is attached in the state shown in FIG. 4B or FIG. 5B depending on the size of a user's head portion.

According to the headphone of the present invention, thus, the opening 10 of the housing 1 can be always blocked by the shielding plate 11 and the protruded portion 12 also in any working condition of the headphone. Therefore, it is possible to prevent foreign substances, dust and the like from entering the housing 1, for example, and to avoid such a danger that fingers might be caught by mistake between the opening 10 and the headband 2 during the attachment of the headphone. Furthermore, it is possible to enhance the design of appearance of the headphone and to increase the value of goods.

Figure 6:
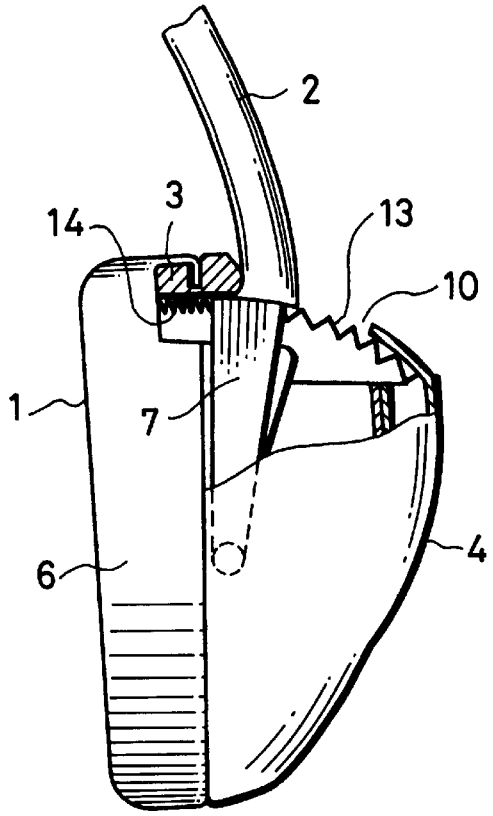
FIG. 6 is a partial sectional view showing the housing in which a bellows-shaped shielding sheet is used for shielding means.
Figure 7:
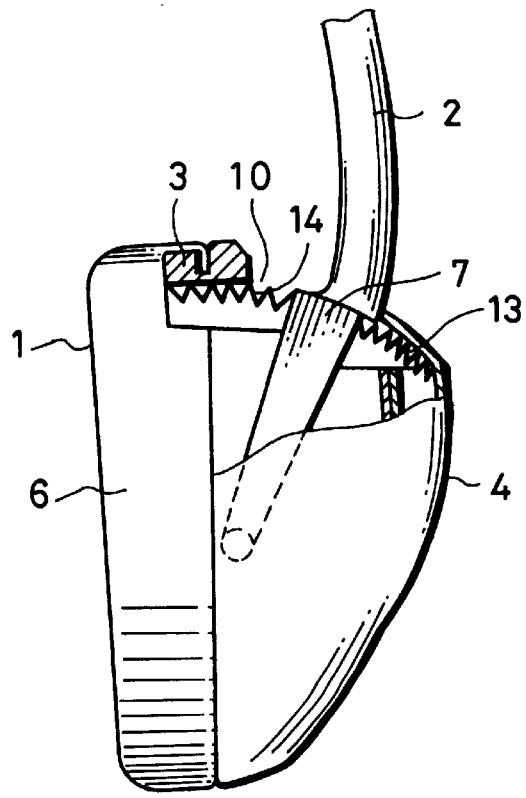
FIG. 7 is a partial sectional view showing a housing in the operation state of FIG. 6.
Figure 8:
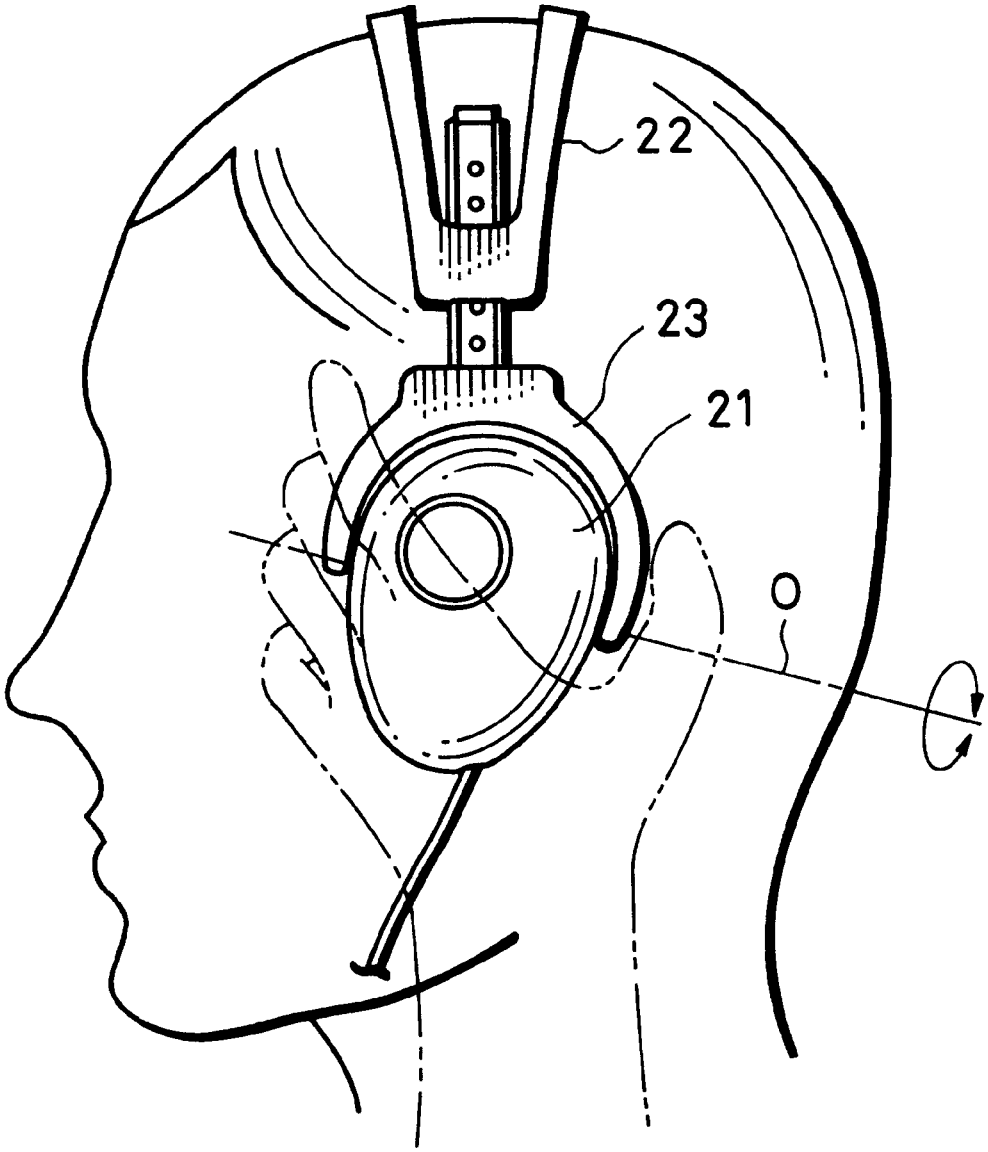
FIG. 8 is a view showing the appearance of a conventional headphone having an exterior type hanger.
Figure 9:
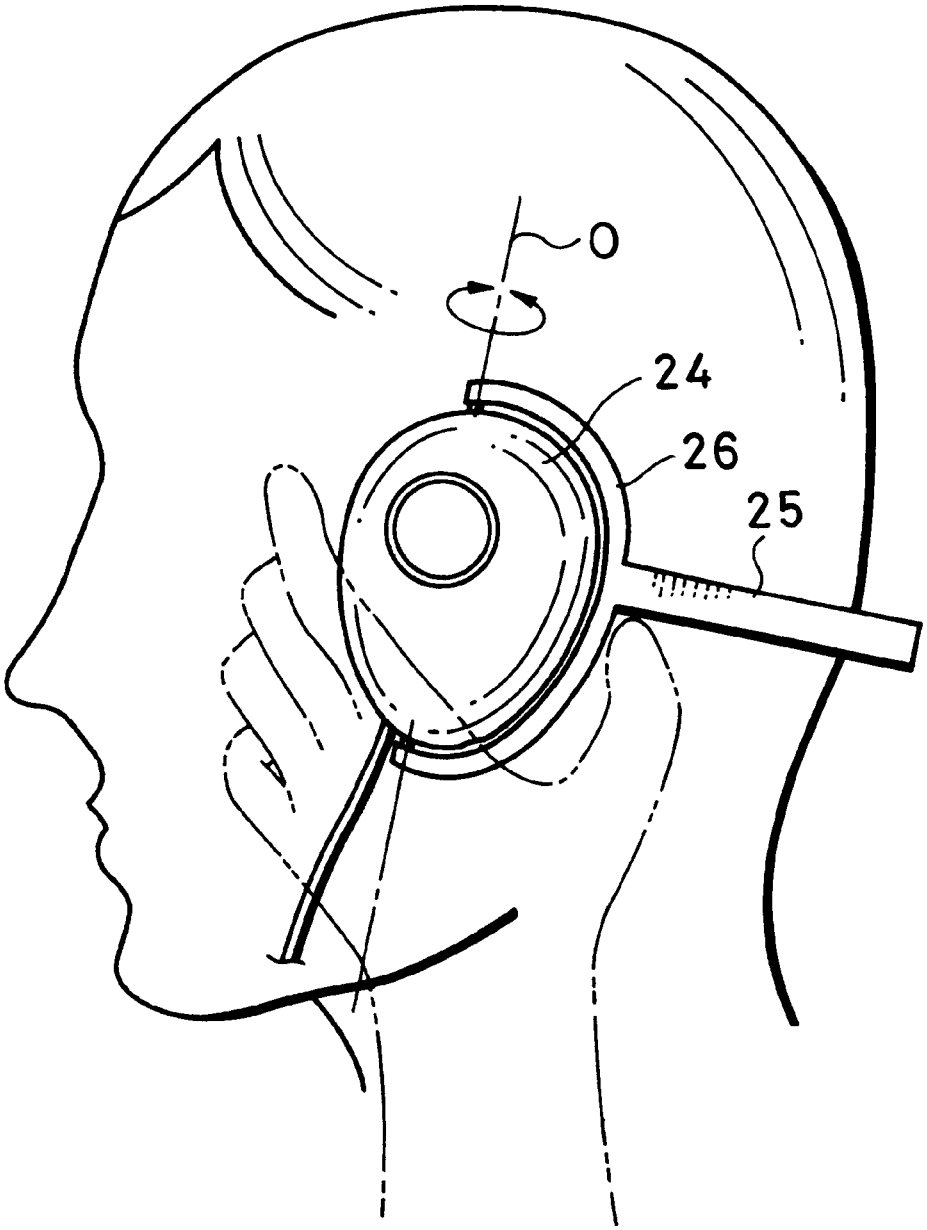
FIG. 9 is a view showing the appearance of a headphone having an exterior type hanger according to another conventional example.
Figure 10:
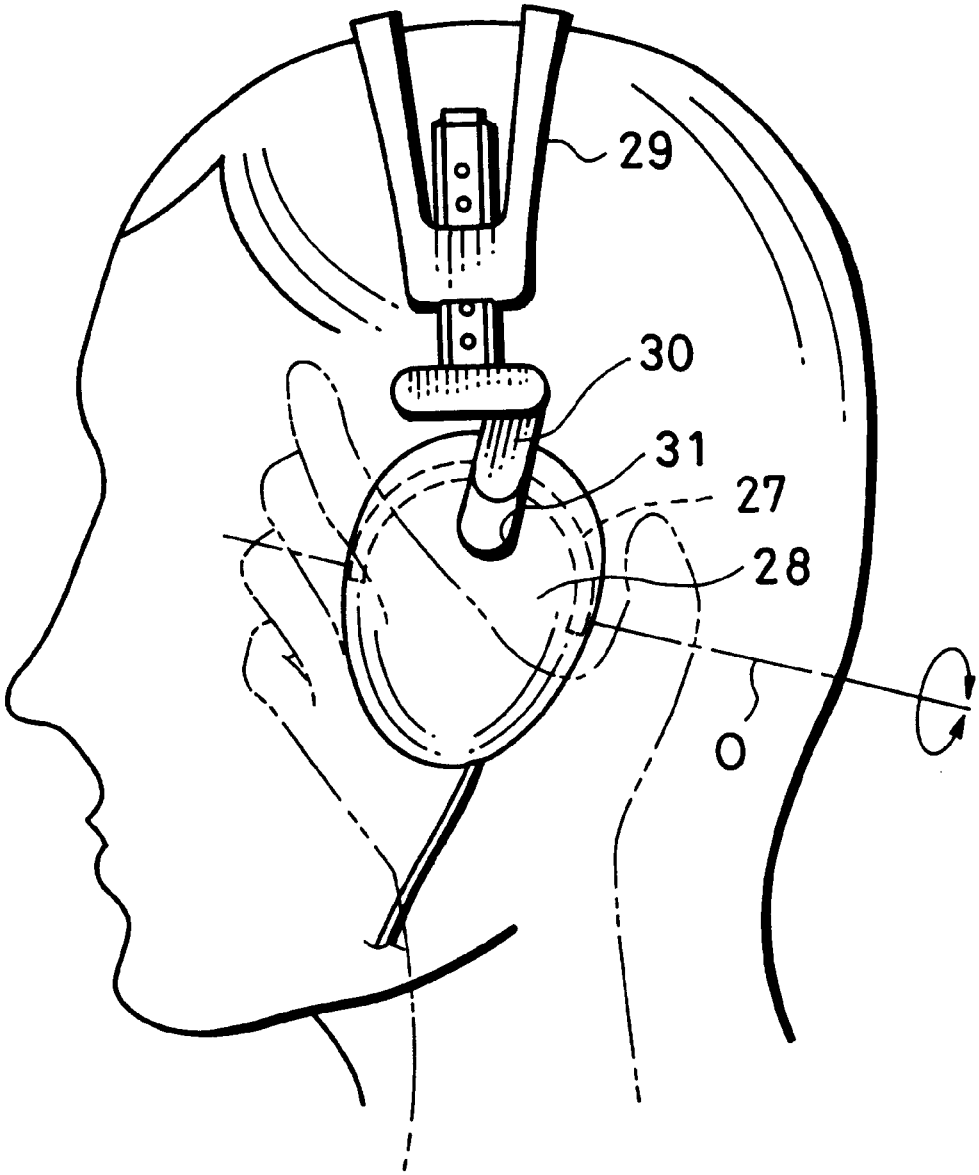
FIG. 10 is a view showing the appearance of a conventional headphone having a storage type hanger.

As another shielding member of the opening 10, a shielding sheet 13 for expanding or contracting like bellows which is formed of a rubber material, a soft plastic material, a cloth or the like may be attached between the hanger 7 and the cover 4 on the inside of the opening 10 and a shielding sheet 14 for expanding or contracting like bellows may be similarly attached between the hanger 7 and the housing body 3 on the inside of the opening 10 as shown in FIGS. 6 and 7.

With such a structure, when the opening 10 is formed between the hanger 7 and the cover 4 as shown in FIG. 6, the shielding sheet 13 can expand to block the opening 10, while the shielding sheet 14 provided on the opposite side contracts. Moreover, when the opening 10 is formed between the hanger 7 and the housing body 3 as shown in FIG. 7, the shielding sheet 14 can expand to block the opening 10, while the shielding sheet 13 provided on the opposite side contracts. Consequently, it is possible to prevent the foreign substances, dust and the like from entering the housing 1. Furthermore, in the case in which the bellows-shaped shielding sheet is used, a manufacturing cost can be reduced.

The housing 1 of the headphone according to the present invention has a sealing structure on the rear face side of the speaker unit 5. Consequently, the acoustic characteristics of the speaker can be enhanced. As an example, a rib-shaped partition wall 15 is formed to surround the speaker unit 5 on the rear face side of the housing body 3 as shown in FIGS. 2 and 3. More specifically, when the cover 4 is closed on the housing body 3, the speaker unit 5 side can have a sealing room structure from the opening 10 side by using the partition wall 15 as a dividing wall. Consequently, the acoustic characteristics of the speaker can be enhanced with a simple structure.

The present invention is not restricted to the above-mentioned embodiment shown in the drawings but can variously be modified without departing from the scope of the invention.

In the headphone according to the present embodiment, the headband 2 can be hung on the rear head portion and the housing 1 can be adjusted in the twist direction. It is also possible to apply a headphone having such a structure that the headband 2 can be hung on the top of the head portion and the housing 1 can be adjusted in the driving direction.

According to the headphone according to the present invention, as described above, the opening formed in the coupling portion of the housing having the speaker unit and the storage type hanger and serving to swing and the headband is concealed by the shielding means. Therefore, it is possible to prevent foreign substances, dust and the like from entering the housing and to avoid such a danger that fingers might be caught by mistake between the opening and the headband during the attachment of the headphone. Furthermore, it is possible to enhance the design of appearance of the headphone and to increase the value of goods.

The opening is shielded by the shielding member extended from the hanger as the shielding means. Consequently, it is possible to effectively block the opening by utilizing the member formed integrally with the hanger.

Moreover, the opening is shielded by the bellows-shaped shielding sheet provided in the headphone housing as the shielding means. Consequently, the shielding means can be manufactured inexpensively.

Furthermore, the partition wall is provided in the headphone housing and the rear face side of the speaker unit has a sealing structure. Consequently, the acoustic characteristics of the speaker can be enhanced with a simple structure.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. A headphone comprising: a hanger attached to a headband and located in a storage-type headphone housing having a speaker unit mounted therein, the hanger being pivotally supported and coupled to the headphone housing so that the headphone housing can be swung in a driving direction or a twist direction with respect to the headband, a coupling portion for coupling the hanger to the headphone housing and being formed so as to be covered and concealed by a part of the headphone housing, and a shielding member protruding from the hanger for blocking a first portion of an opening formed in the headphone housing where the hanger is attached to the headband, and wherein a portion protruding from the headband blocks a second portion of the opening.

2. A headphone comprising a hanger attached to a headband and located in a storage-type headphone housing having a speaker unit mounted therein, the hanger being pivotally supported and coupled to the headphone housing so that the headphone housing can be swung in a driving direction or a twist direction with respect to the headband, a coupling portion for coupling the hanger to the headphone housing and being formed so as to be covered and concealed by a part of the headphone housing, and a shielding member protruding from the hanger for blocking a first portion of an opening formed in the headphone housing where the hanger is attached to the headband, wherein the shielding means blocks the opening by means of a bellows-shaped shielding sheet provided in the headphone housing.

3. The headphone according to claim 2, further comprising:

a partition wall provided in the headphone housing; and a sealing structure provided at a rear face side of the speaker unit.

* * * * *